US006978909B2

(12) United States Patent
Goetzinger et al.

(10) Patent No.: US 6,978,909 B2
(45) Date of Patent: Dec. 27, 2005

(54) CONDENSATE DRAIN PAN FOR AIR CONDITIONING SYSTEM

(75) Inventors: Gregory T. Goetzinger, Grenada, MS (US); Christopher D. Beck, Grenada, MS (US)

(73) Assignee: Advanced Distributor Products LLC, Grenada, MS (US)

( * ) Notice: Subject to any disclaimer, the term of this patent is extended or adjusted under 35 U.S.C. 154(b) by 58 days.

(21) Appl. No.: 10/721,401

(22) Filed: Nov. 25, 2003

(65) Prior Publication Data

US 2005/0109055 A1 May 26, 2005

(51) Int. Cl.[7] ..... B65D 1/34; F25D 21/14
(52) U.S. Cl. ..... 220/571; 62/291
(58) Field of Search ..... 220/571, 572, 220/573, 608, DIG. 6; 62/285, 288, 291; 165/137

(56) References Cited

U.S. PATENT DOCUMENTS 3,027,041 A * 3/1962 Stansbury, Jr. et al. ..... 220/572
4,474,232 A 10/1984 Wright et al.
4,687,604 A * 8/1987 Goettl ..... 261/29
4,856,672 A * 8/1989 Sullivan ..... 220/571
5,071,027 A 12/1991 Sullivan
5,511,386 A 4/1996 Russ et al.
5,613,554 A * 3/1997 Bull et al. ..... 165/150
5,715,697 A 2/1998 Rust, Jr. et al.
5,904,053 A * 5/1999 Polk et al. ..... 62/285
5,966,959 A 10/1999 Stewart
5,987,909 A * 11/1999 Martin, Sr. ..... 62/291
6,360,911 B1 3/2002 Arnold

* cited by examiner

*Primary Examiner*—Nathan J. Newhouse
*Assistant Examiner*—Harry Grosso
(74) *Attorney, Agent, or Firm*—W. Kirk McCord

(57) ABSTRACT

A drain pan for capturing condensate from a cooling coil in an air conditioning system is configured to facilitate condensate drainage from the pan and to inhibit accumulation of condensate therein. The pan includes troughs for collecting condensate and for channeling the condensate to the front part of the pan where the drain openings are located. A back trough has a central hump to enhance the flow of condensate from the back trough in both directions into opposed side troughs. The side troughs are sloped from back to front to conduct the condensate into a front trough to facilitate drainage from the pan. The lowermost portion of the front trough region is defined by a relatively narrow, non-flat area to reduce the amount of condensate residue in the pan.

20 Claims, 6 Drawing Sheets

CONDENSATE DRAIN PAN FOR AIR CONDITIONING SYSTEM

TECHNICAL FIELD

This invention relates generally to air conditioning systems and in particular to a drain pan adapted to capture condensate from a cooling coil in an air conditioning system.

BACKGROUND ART

Air conditioning systems typically include a blower for circulating air to and from an indoor space to be heated or cooled and apparatus for cooling or heating the circulated air, depending on the mode of operation of the system (i.e., either heating or cooling mode). A device (e.g., a compressor) is also provided for circulating a heat transfer fluid (e.g., a vapor compression refrigerant) between indoor and outdoor heat exchanger coils, whereby the air supplied to the space is cooled or heated. When the system is a conventional air conditioning system (i.e., not a heat pump system), the indoor coil functions as a cooling coil (i.e., as an evaporator when a vapor compression refrigerant is used as a heat transfer fluid) to transfer heat from the air flowing across the outside of the coil to the heat transfer fluid flowing inside the coil, and the outdoor coil functions as a heating coil (i.e., as a condenser when a vapor compression refrigerant is used as a heat transfer fluid) to transfer heat from the heat transfer fluid flowing inside the outdoor coil to outdoor air flowing across the outside of the coil. When the air conditioning system is configured as a heat pump, the indoor coil functions as a cooling coil and the outdoor coil functions as a heating coil in the cooling mode, as in a conventional air conditioning system. However, in the heating mode, the functions are reversed (i.e., the indoor coil functions as a heating coil and the outdoor coil functions as a cooling coil).

When a heat exchanger coil is operated as a cooling coil (e.g., an evaporator), air flowing across the coil is dehumidified as well as cooled, causing condensation to form on the coil. This condensation must be disposed of to prevent freezing of the coil and damage to the surrounding building structure. Typically, a drain pan is located beneath the coil to receive condensate runoff. The pan includes an opening in a bottom part of the pan to conduct the condensate accumulated in the pan to an external drainage conduit. Drain pans of various types are known in the art, as exemplified by the following U.S. Pat. Nos. 4,474,232; 5,071,027; 5,511,386; 5,715,697; 5,966,959; and 6,360,911 B1.

It is advantageous to reduce water retention in the pan to the extent feasible, not only to reduce the likelihood of condensate spillage from the pan onto the adjacent building structure, but also to inhibit the formation of mold, rust and other undesirable byproducts of stagnant water in the pan. Further, air flowing through the heat exchanger coil may pick up moisture from excessive water accumulation in the pan, which may result in unwanted humidity in the air supplied to an indoor space.

SUMMARY OF THE INVENTION

In accordance with the present invention, a drain pan for an air conditioning system is provided. The pan is comprised of an inner front wall, an inner back wall and opposed inner side walls defining an inner perimeter of the pan, and an outer front wall, an outer back wall and opposed outer side walls defining an outer perimeter of the pan. The outer front wall has at least one drain opening to allow condensate to drain from the pan and a trough intermediate the inner perimeter and the outer perimeter. The trough is adapted to receive condensate runoff from an air conditioning coil and to conduct the condensate to the drain opening.

In accordance with one aspect of the invention, a portion of the trough between the inner back wall and the outer back wall includes a central hump to facilitate drainage of condensate toward both of the outer side walls. In accordance with another aspect of the invention, the pan is sloped from back to front to conduct condensate to the front part of the pan where the drain opening is located. In accordance with yet another aspect of the invention, a lowermost portion of the trough is defined by a non-flat surface to reduce condensate accumulation in the pan and to enhance condensate flow in the trough.

In accordance with one embodiment of the invention, the trough includes a front trough between the inner front wall and the outer front wall, a back trough between the inner back wall and the outer back wall, a first side trough between a first inner side wall and a first outer side wall and a second side trough between a second inner side wall and a second outer side wall. In accordance with another embodiment of the invention, the drain pan further includes first and second drain openings in the outer front wall. The first opening is generally aligned with the first side trough and said second drain opening is generally aligned with the second side trough.

In accordance with a preferred embodiment of the invention, the front trough is defined by a sloped surface extending downwardly and inwardly from the outer front wall and a curved surface extending downwardly and outwardly from the inner front wall. The intersection of these two surfaces defines a non-flat lowermost portion of the front trough. The back trough is defined by a first curved surface extending downwardly and outwardly from the inner back wall and a second curved surface extending downwardly and inwardly from the outer back wall. The first and second curved surfaces have different radii of curvature, such that their intersection also defines a non-flat lowermost portion of the back trough. Each side trough is defined by first and second sloped surfaces in downwardly converging relationship, with a curved surface intermediate the first and second sloped surfaces. The curved surface defines a lowermost portion of each side trough. Each side trough defines a channel for condensate flow. Each channel is at its deepest and narrowest proximate to the front trough and at its widest and shallowest proximate to the back trough.

BEST MODE FOR CARRYING OUT THE INVENTION

The best mode for carrying out the invention will now be described with reference to the accompanying drawings. Like parts are marked in the specification and drawings with the same respective reference numbers. In some instances, proportions may have been exaggerated in order to more clearly depict certain features of the invention.

Figure 1:
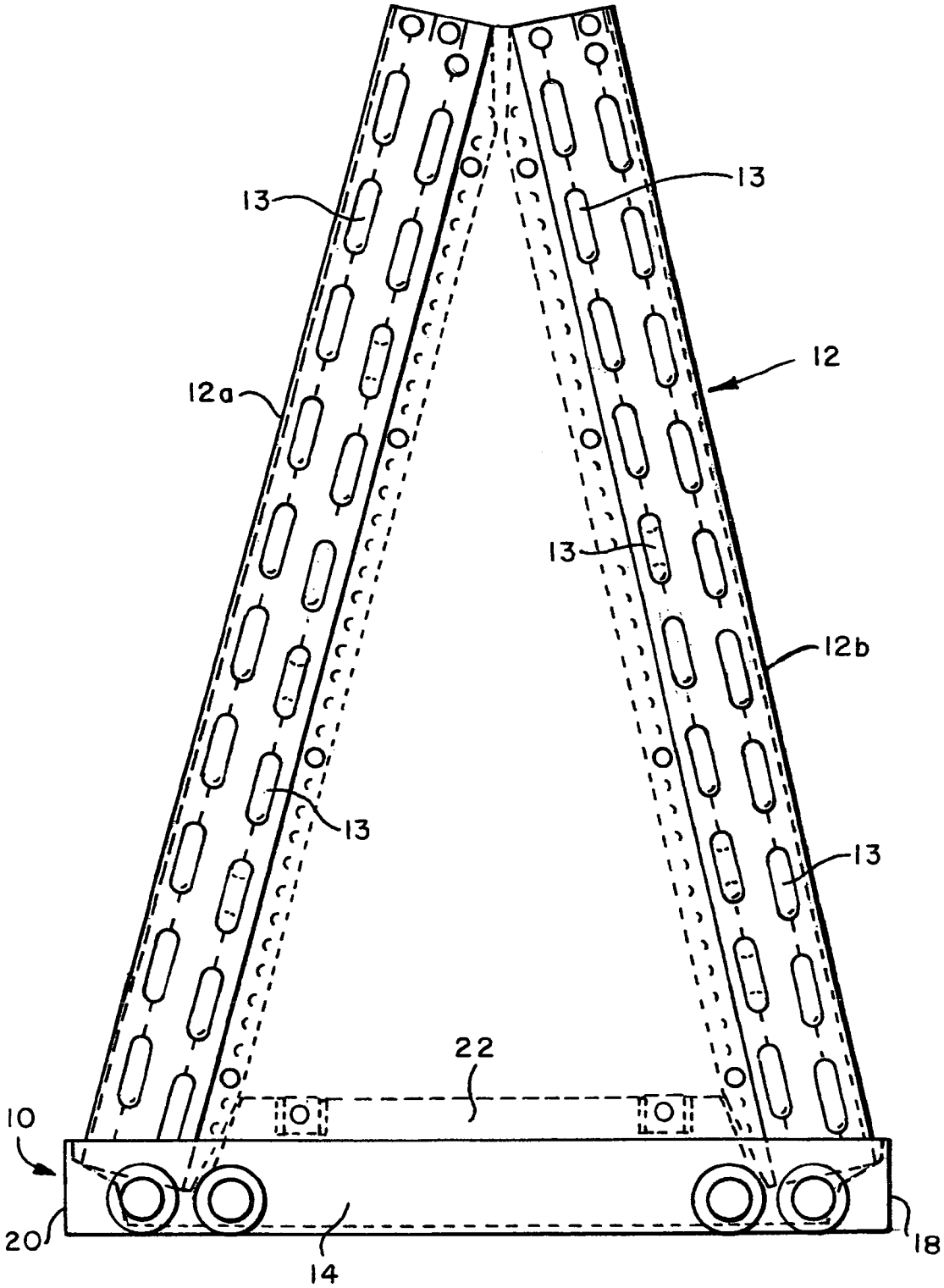
FIG. 1 is a front elevation view of an "A-Coil" heat exchanger, with a drain pan according to the present invention positioned to capture condensate runoff from the heat exchanger.
Figure 2:
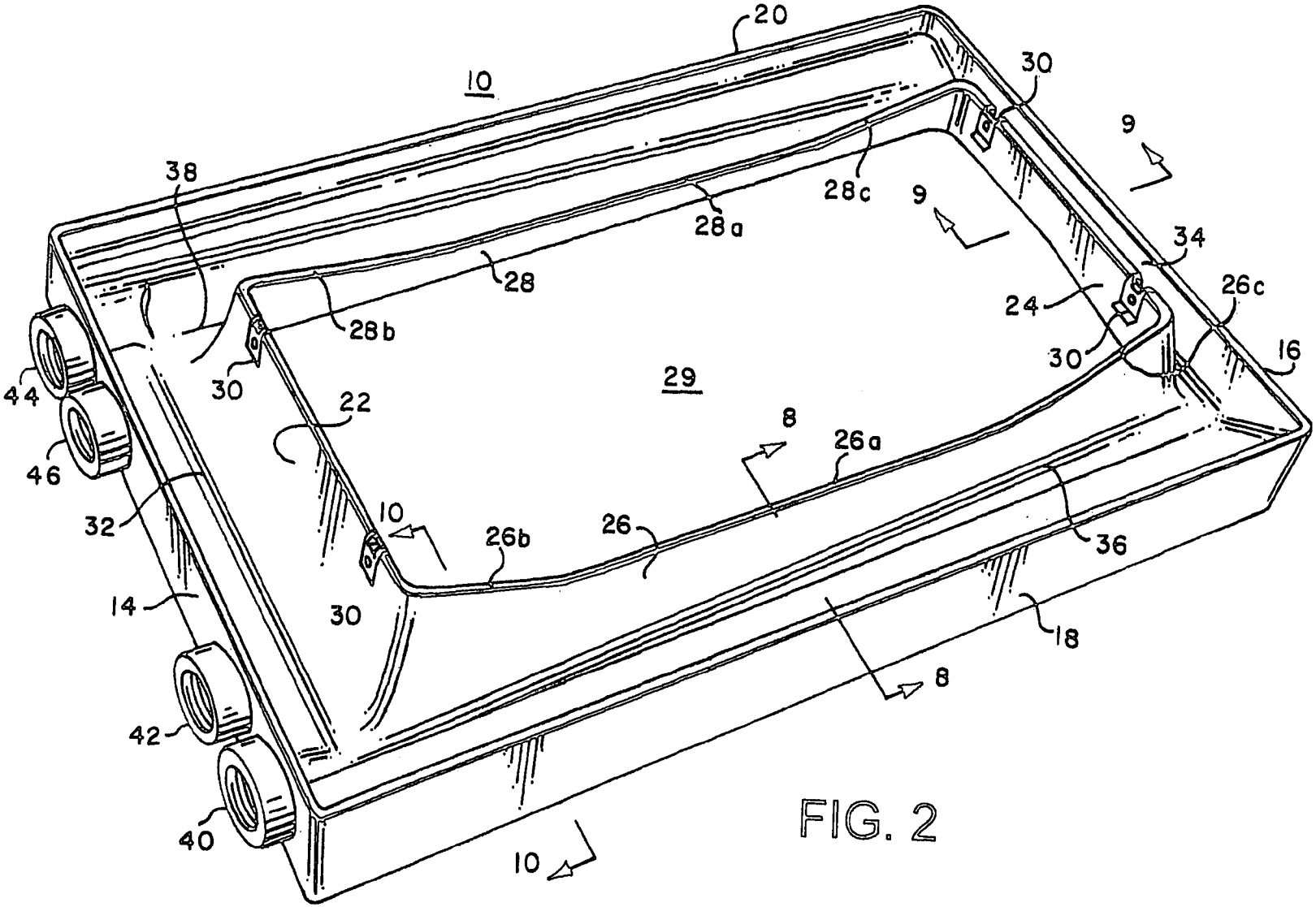
FIG. 2 is a perspective view of the drain pan of FIG. 1.
Figure 3:
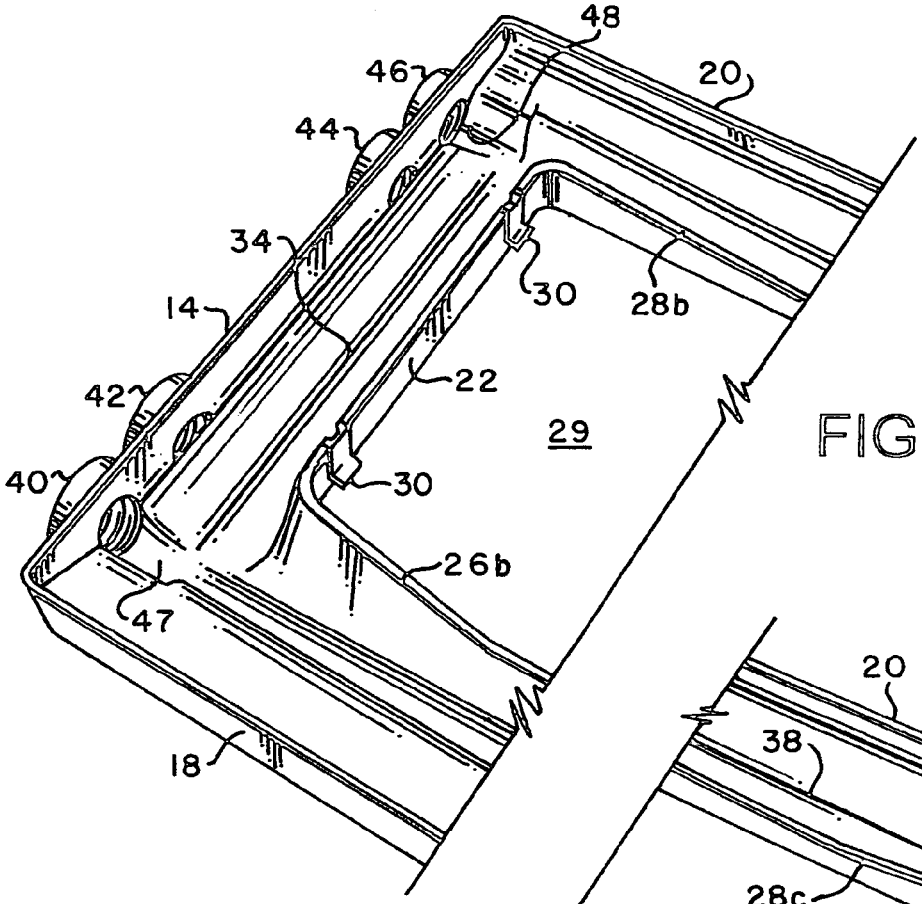
FIG. 3 is a partial perspective view of the drain pan of FIG. 1, showing the front part of the pan.
Figure 4:
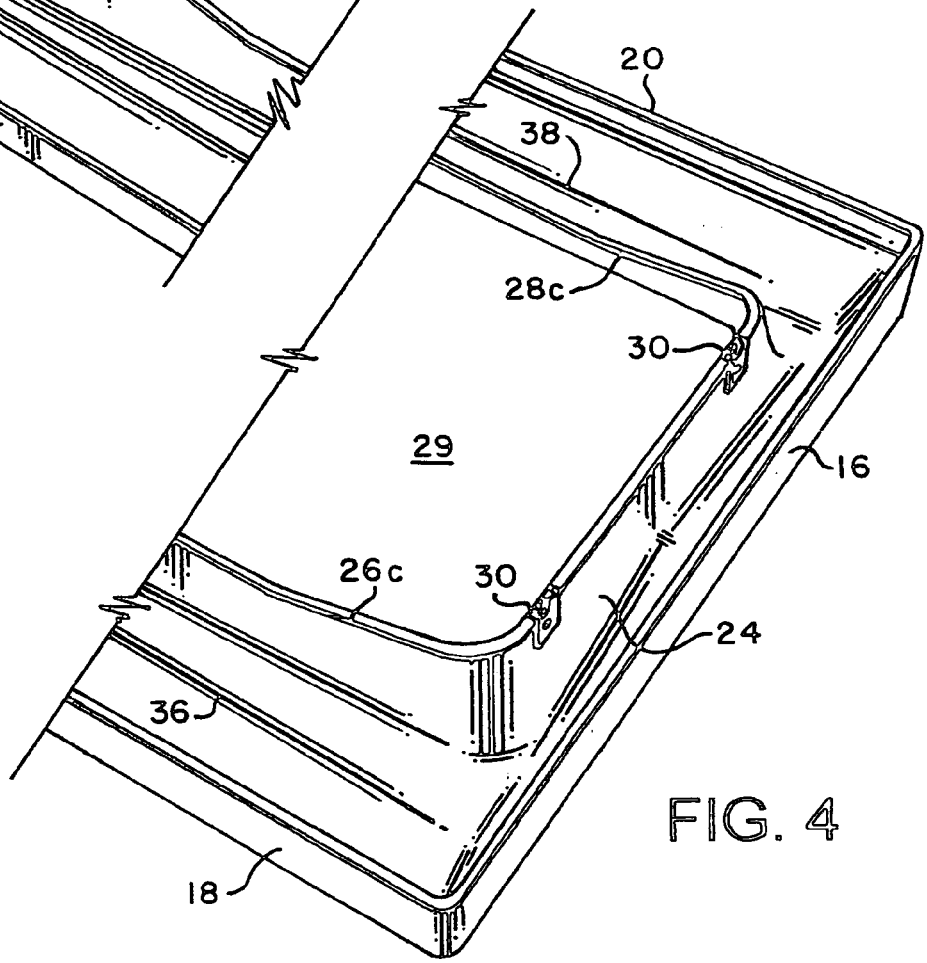
FIG. 4 is a partial perspective view of the drain pan of FIG. 1, showing the back part of the pan.

Referring to FIGS. 1–10, a condensate drain pan 10 according to the present invention is adapted to be positioned underneath a heat exchanger coil 12 in a typical air conditioning system to capture condensate runoff from coil 12 when coil 12 is operated as a cooling coil to cool air flowing through coil 12. For example, coil 12 may be used as an "evaporator" coil, to cool air flowing through coil 12 by evaporating a vapor compression refrigerant flowing inside tubes 13 of coil 12. Coil 12 is depicted in FIG. 1 as a conventional "A-Coil", comprised of a pair of slabs 12*a*, 12*b* coupled together at their respective upper ends and extending downwardly in diverging relationship. Each slab 12*a*, 12*b* is depicted as having two parallel rows of heat transfer fluid carrying tubes 13. However, one skilled in the art will recognize that coil 12 can be configured with more or fewer than two rows of tubes 13.

As can be best seen in FIGS. 2–5, drain pan 10 has a generally rectangular shape and is made of plastic, preferably by an injection molding process. Pan 10 has an outer front wall 14, an outer back wall 16 and opposed outer side walls 18, 20. Walls 14, 16, 18, 20 define a generally rectangular outer perimeter of pan 10. Pan 10 further includes an inner front wall 22, an inner back wall 24 and opposed inner side walls 26, 28. Walls 22, 24, 26, 28 define a generally rectangular inner perimeter of pan 10, which surrounds a central opening 29. Opening 29 allows the air to be cooled to flow upwardly through pan 10 into coil 12 between slabs 12*a*, 12*b* and then outwardly through slabs 12*a*, 12*b*, where heat is transferred from the air to the heat transfer fluid in tubes 13 to cool the air. Located on inner front wall 22 and inner back wall 24 are mounting clips 30, which are adapted for mounting heat exchanger coil 12 in a fixed position with respect to drain pan 10 in a conventional manner. As can be best seen in FIG. 2, respective intermediate portions 26*a*, 28*a* of inner side walls 26, 28 are reduced in height compared to front and back walls 22, 24 to enhance the air flow through coil 12. Inner side wall 26 further includes sloped portions 26*b*, 26*c* on opposed sides of intermediate portion 26*a*. Sloped portion 26*b* is proximate to inner front wall 22 and sloped portion 26*c* is proximate to inner back wall 24. Inner side wall 28 further includes sloped portions 28*b*, 28*c* on opposed sides of intermediate portion 28*a*. Sloped portion 28*b* is proximate to inner front wall 22 and sloped portion 28*c* is proximate to inner back wall 24.

The bottom part of drain pan 10 between the inner perimeter and outer perimeter thereof is a condensate collection region comprised of a front trough 32, a back trough 34 and opposed side troughs 36, 38. Front trough 32 is located between outer front wall 14 and inner front wall 22. Back trough 34 is located between outer back wall 16 and inner back wall 24. Side trough 36 is located between outer side wall 18 and inner side wall 26 and side trough 38 is located between outer side wall 20 and inner side wall 28.

Outer front wall 14 includes respective primary and secondary drain openings 40, 42 adjacent side trough 36 and respective primary and secondary drain openings 44, 46 adjacent side trough 38. Both sets of drain openings are adapted for attachment to an external conduit (not shown) for draining condensate from pan 10. By having two sets of drain openings, either side of pan 10 may be used to drain condensate therefrom. The set of drain openings not in use is capped to prevent condensate drainage therefrom. As can be best seen in FIGS. 2, 3, 5 and 10, primary drain opening 40 is generally aligned with side trough 36 and is located proximate to a relatively small depression 47, which is located at the confluence of side trough 36 and front trough 32, to facilitate drainage of condensate from pan 10. Similarly, primary drain opening 44 is located proximate to a relatively small depression 48, which is located at the confluence of side trough 38 and front trough 32. Depressions 47, 48 define the lowermost portions of pan 10. In the event that the primary drainage conduit in use becomes blocked, condensate will back up into front trough 32 through the corresponding primary drain opening 40 or 44 until it reaches the level of the corresponding secondary drain opening 42 or 46, whereupon condensate will flow out of drain pan 10 through the corresponding secondary drain 42 or 46.

Figure 5:
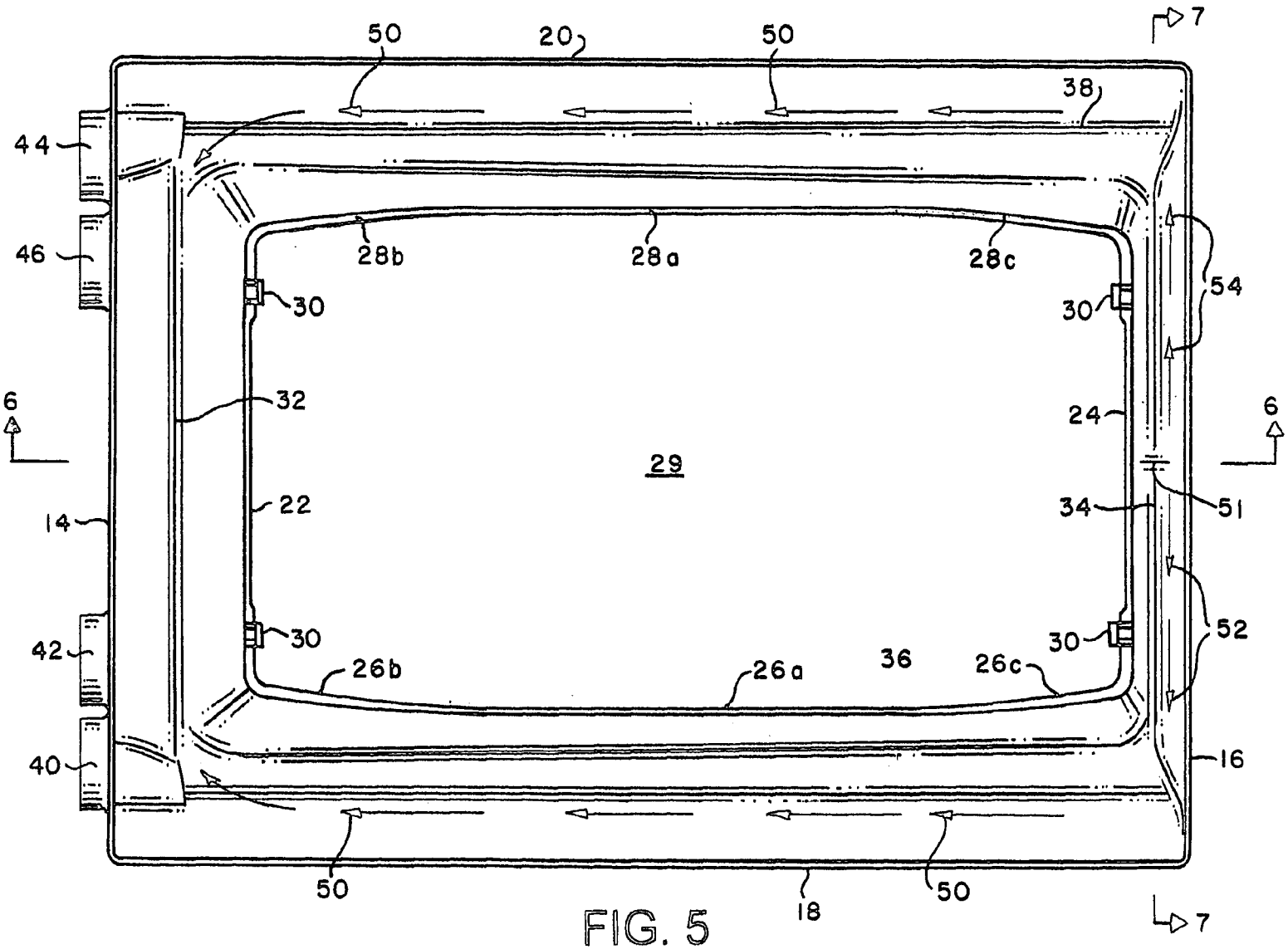
FIG. 5 is a top plan view of the drain pan of FIG. 1.
Figure 6:
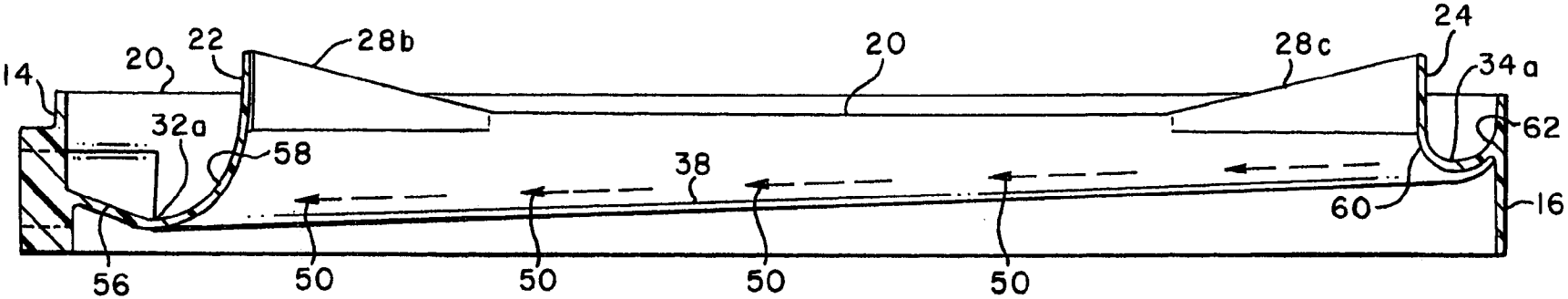
FIG. 6 is a sectional view, taken along the line 6—6 in FIG. 5.
Figure 7:
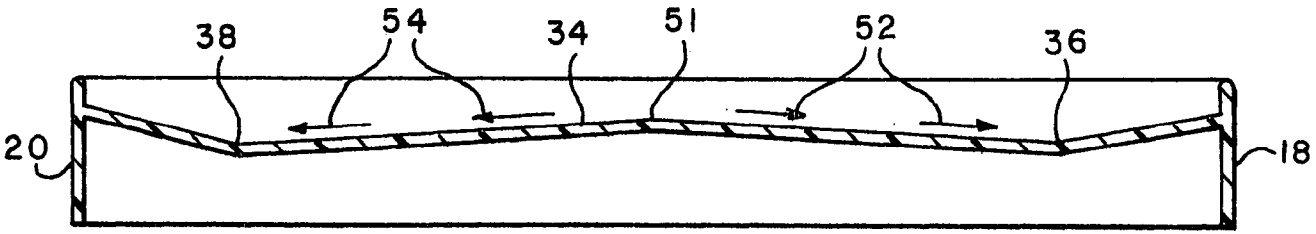
FIG. 7 is a sectional view, taken along the line 7—7 in FIG. 5.

The respective bottom portions of side troughs 36, 38 are sloped from back trough 34 to front trough 32 at an angle of about 2° relative to a horizontal axis, to enhance the flow of condensate to the front part of pan 10, as shown by arrows 50 in FIGS. 5 and 6. Further, as can be best seen in FIG. 7, back trough 34 has a central raised portion or hump 51 and is sloped from hump 51 toward both side troughs 36, 38 at an angle of about 4° relative to a horizontal axis, to cause condensate in back trough 34 to flow away from hump 51 in the direction of both side troughs 36, 38 (as represented by arrows 52, 54, respectively). Therefore, pan 10 is configured to direct the flow of condensate from back trough 34 into side troughs 36, 38 and from side troughs 36, 38 into front trough 32.

As can be best seen in FIG. 6, front trough 32 is defined by a sloped surface 56 extending downwardly and inwardly from outer front wall 14 at a substantially constant angle of about 20° relative to a horizontal axis and a curved surface 58 extending downwardly and outwardly from inner front wall 22 at a predetermined radius of curvature (e.g., about 1.1343 inches). The intersection of surfaces 56, 58 defines a non-flat bottom 32*a* of front trough 32, which enhances condensate flow in front trough 32 and reduces condensate accumulation therein. Bottom 32*a* is slightly elevated with respect to depressions 47, 48, so that substantially all of the condensate in pan 10 finds its way into one of the depressions 47, 48. Condensate will flow from the depression 47, 48 that is in communication with the primary drain 40, 44 in use. However, condensate in the opposite depression 47, 48 will remain in pan 10, but the amount that remains is negligible because volume of depressions 47, 48 is relatively small. Further, by configuring bottom 32*a* so that it is relatively narrow channel defined by a non-flat surface, the flow of condensate in front trough 32 is enhanced, which facilitates drainage of the condensate from pan 10.

Figure 9:
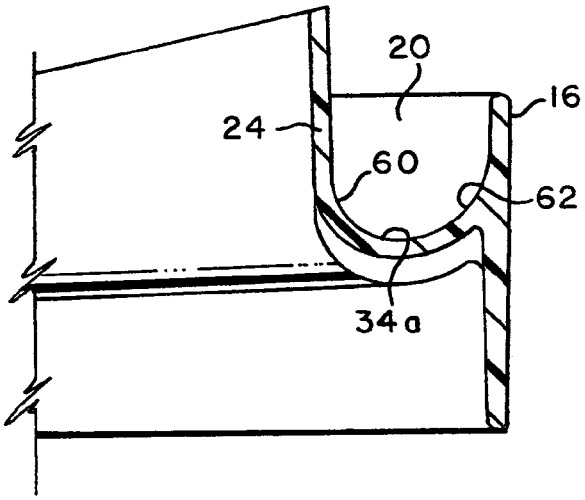
FIG. 9 is a sectional view, taken along the line 9—9 in FIG. 2.

As can be best seen in FIGS. 6 and 9, back trough 34 is defined by curved surfaces 60, 62 having different radii of curvature. For example, surface 60 preferably has a radius of curvature of about 0.4095 inch, while surface 62 preferably has a radius of curvature of about 0.4960 inch, so that the curvature of surface 60 is slightly more pronounced than the curvature of surface 62. Curved surface 60 extends downwardly and outwardly from inner back wall 24 and curved surface 62 extends downwardly and inwardly from outer back wall 16. The intersection of surfaces 60, 62 defines a non-flat bottom 34*a* of back trough 34, which along with hump 51 enhances condensate flow in back trough 34 and reduces condensate accumulation therein.

Figure 8:
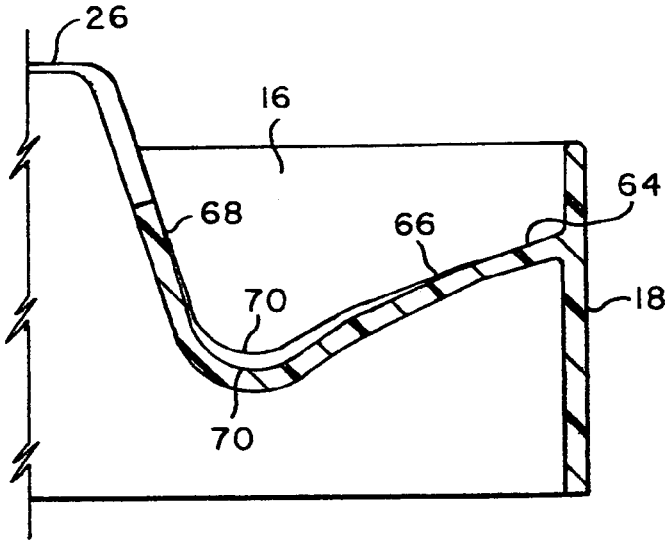
FIG. 8 is a sectional view, taken along the line 8—8 in FIG. 2.
Figure 10:
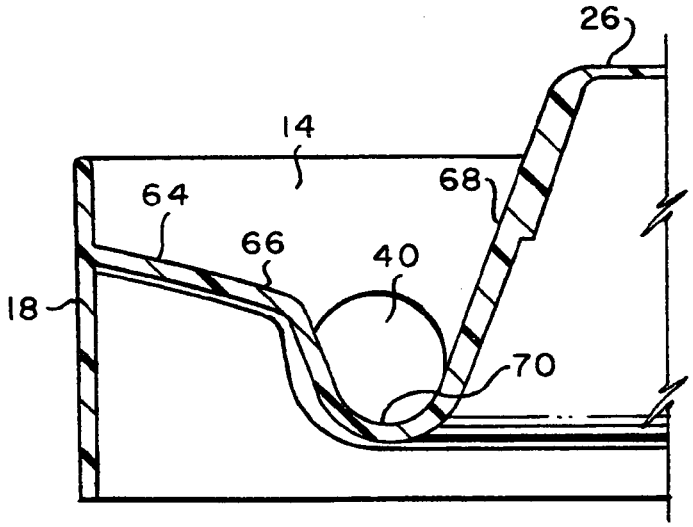
FIG. 10 is a sectional view, taken along the line 10—10 in FIG. 2.

As can be best seen in FIGS. 8 and 10, side trough 36 is defined by sloped surfaces 64, 66 extending downwardly and inwardly from outer side wall 18 and a sloped surface 68 extending downwardly and outwardly from inner side wall 26. A curved surface 70 is intermediate sloped surfaces 66, 68 and defines a non-flat bottom portion of side trough 36. Sloped surfaces 66, 68 are sloped at angles of about 20° and 70° degrees, respectively, relative to a horizontal axis, along the entire length of side trough 36. However, the slope angle of surface 64 changes along the length of side trough 36. For example, the slope angle of surface 64 is greatest proximate to front trough 32 (e.g., about 20°), as shown in FIG. 10 and least proximate to rear trough 34 (e.g., about 12°). The slope angle of surface 64 is about 16° at the approximate midpoint of side trough 36 between front and back troughs 32, 34, as shown in FIG. 8.

The radius of curvature of curved surface 70 also varies along the length of side trough 36. The curvature is more pronounced in proximate to front trough 32 (e.g., radius of curvature of about 0.3344 inch), as shown in FIG. 9 and least pronounced proximate to back trough 34 (e.g., radius of curvature of about 0.4752 inch). At the approximate midpoint of side trough 36, the radius of curvature of surface 70 is intermediate the respective radii of curvature of surface 70 proximate to front and back troughs 32, 34 (e.g., about 0.4048 inch). As previously described, bottom portion 36*a* slopes downwardly from back trough 34 to front trough 32 at an angle of about 2°, so that side trough 36 is at its deepest proximate to front trough 32 and is at its shallowest proximate to back trough 34. Although described in detail herein, one skilled in the art will recognize that side trough 38 has the same configuration as side trough 36, as described hereinabove.

In accordance with the present invention, a drain pan is provided for use in an air conditioning system. The pan is adapted to enhance the flow of condensate captured by the pan toward the drain opening, to facilitate drainage of condensate from the pan and inhibit accumulation of condensate in the pan.

The best mode for carrying out the invention has now been described in detail. Since changes in and additions to the above-described best mode can be made without departing from the nature, spirit and scope of the invention, the invention is not to be limited to the above-described best mode, but only by the appended claims and their equivalents.

What is claimed is:

1. A condensate drain pan, comprising:

an inner front wall, an inner back wall and opposed inner side walls defining an inner perimeter of said pan;

an outer front wall, an outer back wall and opposed outer side walls defining an outer perimeter of said pan;

a drain opening in said pan to allow condensate to drain therefrom; and a trough intermediate said inner perimeter and said outer perimeter, said trough being adapted to conduct condensate to said drain opening, said trough including a front trough between said inner front wall and said outer front wall, a back trough between said inner back wall and said outer back wall, a first side trough between a first inner side wall and a first outer side wall and a second side trough between a second inner side wall and a second outer side wall, at least one of said first and second side troughs being at least partially defined by a curved surface having a greater radius of curvature proximate to said back trough than proximate to said front trough.

2. The drain pan of claim 1 wherein said at least one of said first and second side troughs extends longitudinally between said front trough and said back trough, said curved surface having a radius of curvature that varies along a longitudinal axis of said at least one of said first and second side troughs, said at least one of said first and second side troughs being deeper and narrower proximate to said front trough than proximate to said back trough.

3. The drain pan of claim 1 wherein said at least one of said first and second side troughs is further defined by a first sloped surface extending downwardly and inwardly from one of said first and second outer side walls and a second sloped surface extending downwardly and outwardly from one of said first and second inner side walls, said curved surface being intermediate said first and second sloped surfaces, the slope of at least one of said first and second sloped surfaces being greater proximate to said front trough than proximate to said back trough.

4. The drain pan of claim 3 wherein the slope of said second sloped surface is greater proximate to said front trough than proximate to said back trough.

5. The drain pan of claim 4 wherein said at least one of said first and second side troughs extends longitudinally between said front trough and said back trough, the slope of said second sloped surface being variable along a longitudinal axis of said at least one of said first and second side troughs.

6. The drain pan of claim 3 wherein said at least one of said first and second side troughs extends longitudinally between said front trough and said back trough, the slope of said at least one of said first and second sloped surfaces being variable along a longitudinal axis of said at least one of said first and second side troughs.

7. The drain pan of claim 1 wherein said first and second side troughs are sloped downwardly from said back trough to said front trough to conduct condensate from said back trough to said front trough.

8. The drain pan of claim 1 wherein said drain opening is located in said outer front wall and is generally aligned with one of said first and second side troughs.

9. The drain pan of claim 1 wherein said front trough is defined by first and second surfaces in downwardly converging relationship and intersecting at a lowermost portion of said front trough, the intersection of said first and second surfaces defining a non-flat lowermost portion of said front trough.

10. The drain pan of claim 9 wherein said first surface is relatively straight with a predetermined downward slope and said second surface is curved with a predetermined radius of curvature.

11. The drain pan of claim 1 wherein said back trough is defined by first and second surfaces in downwardly converging relationship and intersecting at a lowermost portion of said back trough, the intersection of said first and second surfaces defining a non-flat lowermost portion of said back trough.

12. The drain pan of claim 11 wherein said first and second surfaces are curved and have different radii of curvature.

13. The drain pan of claim 1 wherein at least one of said first side trough and said second side trough is sloped downwardly from said back trough to said front trough.

14. The drain pan of claim 1 further including a depression proximate to said drain opening, said depression being below said trough and defining a lowermost part of said drain pan.

15. The drain pan of claim 14 wherein said drain opening is generally aligned with one of said first and second side troughs, said front trough extending between said first and second side troughs, said depression being located at a confluence of said front trough with said one of said first and second side troughs.

16. The drain pan of claim 14 further including a first drain opening generally aligned with said first side trough and a second drain opening generally aligned with said second side trough, said drain pan having a first depression proximate to said first drain opening and a second depression proximate to said second drain opening, said first and second depressions being below said trough and defining respective lowermost parts of said pan, said first depression being located at a confluence of said front trough with said first side trough and said second depression being located at a confluence of said front trough with said second side trough.

17. The drain pan of claim 1 wherein said back trough has a central hump configured to direct condensate in said back trough toward both of said first and second side troughs.

18. The drain pan of claim 1 wherein at least a portion of at least one of said inner side walls is reduced in height relative to said inner front wall and said inner back wall.

19. The drain pan of claim 18 wherein at least a portion of each of said inner side walls is reduced in height relative to said inner front wall and said inner back wall.

20. The drain pan of claim 18 wherein an intermediate portion of said at least one of said inner side walls is reduced in height relative to said inner front wall and said inner back wall, said at least one of said inner side walls further including a first sloped portion sloping downwardly from said inner front wall to said intermediate portion and a second sloped portion sloping downwardly from said inner back wall to said intermediate portion.

* * * * *